US009380869B2

(12) United States Patent
Fu

(10) Patent No.: US 9,380,869 B2
(45) Date of Patent: Jul. 5, 2016

(54) STORAGE SHELF

(71) Applicant: Bestmate International Development Co., Ltd., Yilan County (TW)

(72) Inventor: Kuang-Huan Fu, Yilan County (TW)

(73) Assignee: BESTMATE INTERNATIONAL DEVELOPING CO., LTD., Yilan County (TW)

( * ) Notice: Subject to any disclaimer, the term of this patent is extended or adjusted under 35 U.S.C. 154(b) by 0 days.

(21) Appl. No.: 14/453,587

(22) Filed: Aug. 6, 2014

(65) Prior Publication Data

US 2016/0037915 A1 Feb. 11, 2016

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 57/54*** | (2006.01) |
| ***A47B 57/34*** | (2006.01) |

(52) U.S. Cl.

CPC ..... *A47B 57/545* (2013.01); *A47B 47/0083* (2013.01); *A47B 57/34* (2013.01)

(58) Field of Classification Search

CPC . A47B 57/545; A47B 57/265; A47B 47/0083
See application file for complete search history.

(56) References Cited

U.S. PATENT DOCUMENTS 4,318,352 A * 3/1982 Friedman ..... A47B 57/265 108/107
4,582,001 A * 4/1986 Leikarts ..... A47B 57/265 108/106
4,627,543 A * 12/1986 Nicely ..... A47B 57/265 108/147.13
D291,165 S * 8/1987 Ray ..... D6/675.2
5,884,567 A * 3/1999 Bartz, Jr. ..... 108/106
6,044,988 A * 4/2000 Yang ..... A47B 57/265 108/107
6,068,143 A * 5/2000 Wang ..... A47B 57/265 108/144.11
6,253,687 B1 * 7/2001 McAllister ..... A47B 57/545 108/107
6,257,426 B1 * 7/2001 Masunaka ..... A47B 46/00 108/107
6,302,284 B1 * 10/2001 Zonshin ..... A47B 47/0083 108/147.11
6,357,611 B1 * 3/2002 Chen ..... A47B 57/26 108/107
6,364,138 B1 * 4/2002 Chen ..... A47B 57/26 108/147.13
6,695,156 B1 * 2/2004 Wang ..... A47B 57/265 108/147.11
6,748,878 B2 * 6/2004 Chen ..... A47B 57/265 108/147.13
7,093,728 B2 * 8/2006 Chen ..... A47B 57/545 211/153
7,478,971 B2 * 1/2009 Li ..... A47B 57/545 108/147.13
7,543,540 B2 * 6/2009 Tatematsu ..... A47B 47/047 108/192

(Continued)

FOREIGN PATENT DOCUMENTS

CN WO 2005013767 A1 * 2/2005 ..... A47B 57/34
DE 202015101455 U1 * 5/2015

*Primary Examiner* — Joshua Rodden
*Assistant Examiner* — Kimberley S Wright
(74) *Attorney, Agent, or Firm* — Leong C. Lei

(57) ABSTRACT

A storage shelf includes a secure sleeve and a bracket that the secure sleeve is in a hollow cylinder shape with an outer circumference on which two symmetrical slots, constructed by L-shape elements, in a downward and skewed taper shape, are provided. A buckling piece, of a curve and in a downward and skewed taper shape, is provided at four corners of the bracket respectively. After assembling the multiply secure sleeves to a support tube, the buckling piece of the bracket is inserted into one slot of the secure sleeve so as to firmly position the bracket to the support tube for constituting a unity storage shelf. The other slot of the secure sleeve can be engaged by the buckling piece of the other bracket to extend multiply storage shelf in a parallel arrangement for achieving convenience for both assembly and extension in an orderly manner.

6 Claims, 6 Drawing Sheets

(56) References Cited

U.S. PATENT DOCUMENTS 8,016,140 B2 * 9/2011 Hsieh ..... A47B 47/0083 211/187
8,376,156 B2 * 2/2013 Jarvis ..... A47B 47/045 108/147.12
8,376,157 B2 * 2/2013 Jarvis ..... A47B 47/045 108/147.12
8,505,751 B2 * 8/2013 Shinozaki ..... A47B 47/0083 108/147.13
8,505,752 B2 * 8/2013 Shinozaki ..... A47B 47/0083 108/147.13
8,627,966 B2 * 1/2014 Jarvis ..... A47B 55/00 211/187
8,651,300 B2 * 2/2014 Chen ..... A47B 47/024 108/107
8,757,400 B2 * 6/2014 Bosch ..... B01L 9/06 211/126.12
9,167,915 B1 * 10/2015 Lau
2002/0113180 A1 * 8/2002 Wiebe ..... A47B 57/265 248/188
2003/0131767 A1 * 7/2003 Chen ..... A47B 57/265 108/147.13
2005/0139562 A1 * 6/2005 Chen ..... A47B 57/545 211/187
2005/0199160 A1 * 9/2005 Ching-Po ..... A47B 57/265 108/107
2007/0108147 A1 * 5/2007 Chen ..... A47B 47/00 211/187
2007/0161280 A1 * 7/2007 Li ..... A47B 57/545 439/352
2009/0184076 A1 * 7/2009 Lee ..... 211/103
2009/0184078 A1 * 7/2009 Lee ..... A47B 57/54 211/187
2012/0298607 A1 * 11/2012 Chen ..... A47B 57/265 211/186
2013/0175233 A1 * 7/2013 Wu ..... 211/183
2014/0314470 A1 * 10/2014 Wu ..... A47B 47/045 403/217
2015/0001169 A1 * 1/2015 Chen ..... A47B 87/0223 211/188
2015/0289644 A1 * 10/2015 Sabounjian ..... 211/187

* cited by examiner

STORAGE SHELF

TECHNICAL FIELD OF THE INVENTION

The present invention is related to a storage shelf, particularly a storage shelf for convenient assembly and extension by parallel connection in an orderly manner.

DESCRIPTION OF THE PRIOR ART

A structure and assembly of an ordinary assembled rack is shown in FIG. 1 that includes a support tube 1, a clip 2 and a bracket 3. A groove 11 is circumferentially provided at the support tube 1 at a proper interval in between each other, an inner side of the clip 2 is provided with a rib 21, and a corner of the bracket 3 is provided with a fixing ring 31. During assembly the rib 21 of the clip 2 is first to engage the groove 11 of the support tube 1 and then the fixing ring 31 is inserted from above to tighten the clip 2 so as to put the fixing ring 31 in position and secure the bracket 3 to the support tube 1 (at quantity of four) in order to constitute an assembled rack. The assembled rack of the prior art is difficult to keep at a balance state during assembly period so that one person can hardly proceed with the assembly alone. The structure of the assembled rack of the prior art can only allow a side-by-side arrangement without positioning function so that multiply quantity of the assembled rack of the prior art cannot be placed in an orderly manner and even out of order upon impact by accident.

SUMMARY OF THE INVENTION

An objective of the present invention is to provide a storage shelf with advantages of convenient assembly and extension in an orderly manner.

The storage shelf of the present invention includes a secure sleeve and a bracket that the secure sleeve is in a hollow cylinder shape with an outer circumference on which a pair of symmetrical slots in a downward and skewed taper shape are provided. A buckling piece, which is of a curve and in a downward and skewed taper shape, is provided at each of four corners of the bracket. After assembling multiply quantity of the secure sleeve to a support tube, the buckling piece of the bracket is inserted into one of the slots of the secure sleeve so as to firmly position the bracket to the support tube for constituting a unity storage shelf. The other slot of the secure sleeve can be engaged by the buckling piece of the other bracket in order to extend a multiply quantity of the storage shelf in a parallel arrangement so as to achieve a convenience for both assembly and extension in an orderly manner.

The slots provided at the outer circumference of the secure sleeve of aforesaid storage shelf are constructed by two L-shape sheet elements with respect to each other.

DETAILED DESCRIPTION OF THE PREFERRED EMBODIMENTS

Figure 1:
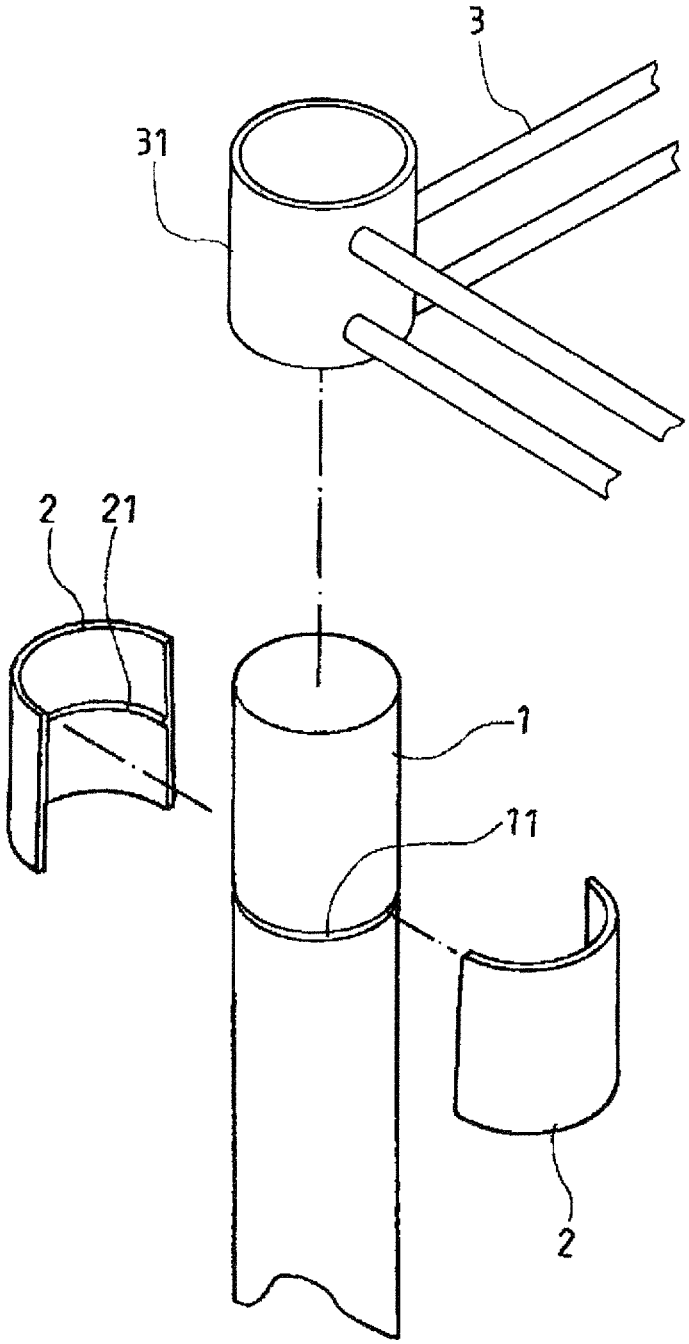
PRIOR ART FIG. 1
FIG. 1 is a three-dimensional diagram illustrating a disassembly of an assembled rack of the prior art.
Figure 2:
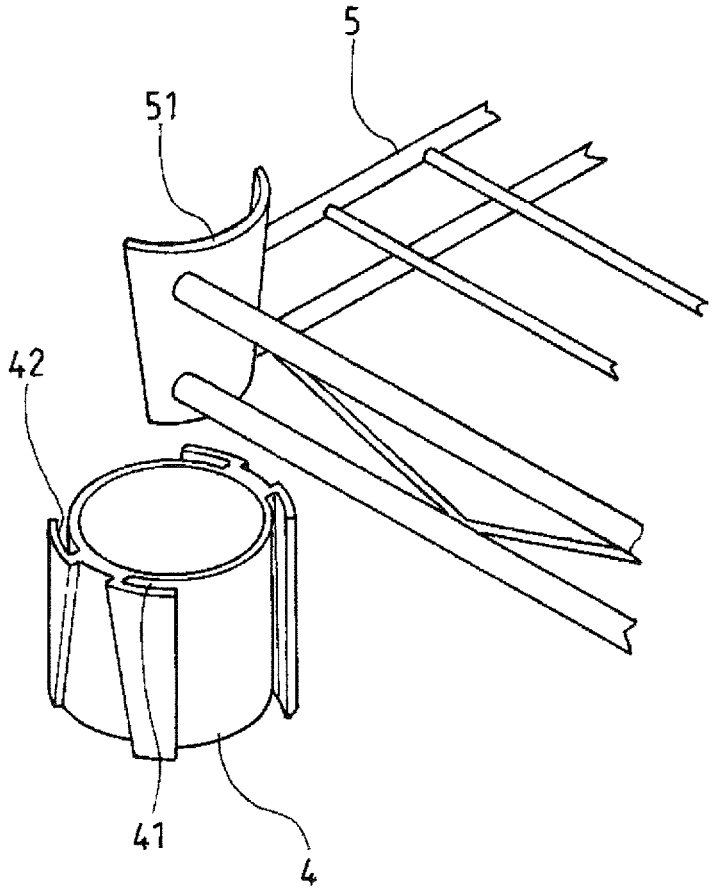
FIG. 2 is a three-dimensional diagram illustrating a disassembly of a preferred embodiment of the present invention.

Please refer FIG. 2, a three-dimensional assembly diagram of a preferred embodiment of the present invention. The preferred embodiment includes a secure sleeve 4 and a bracket 5 that the secure sleeve 4 is in a hollow cylinder shape with an outer circumference on which at least a first slot 41 and a second slot 42 are provided in a symmetrical arrangement. In this embodiment the first slot 41 and the second slot 42 are constituted by two L-shape sheet elements with respect to each other that both the first slot 41 and the second slot 42 are configured in a downward and skewed taper shape. Four corners of the bracket 5 are provided with a buckling piece 51 respectively that the buckling piece 51 is corresponding to a curvature of the secure sleeve 4 and in a downward and skewed taper shape.

According to the above-mentioned, a multiply quantity of the secure sleeve 4 is respectively placed onto a support tube 1 of the prior art that the buckling piece 51 of the bracket 5 is engaged as inserted into one of the first slot 41 of the secure sleeve 4 so as to firmly position the bracket 5 on four support tube 1 for constituting an unity storage shelf while the second slot 42 can be used to engage the buckling piece 51 of the other bracket 5 in order to extend the multiply quantity of the bracket 5 by parallel connection. Hence the storage shelf of the preferred embodiment of the present invention is convenient not only for the assembly (relatively easy in achieving a balancing state and thus one person alone can proceed with assembly operation) but also for the extension of the multiply quantity by a parallel arrangement in an orderly manner.

Figure 3:
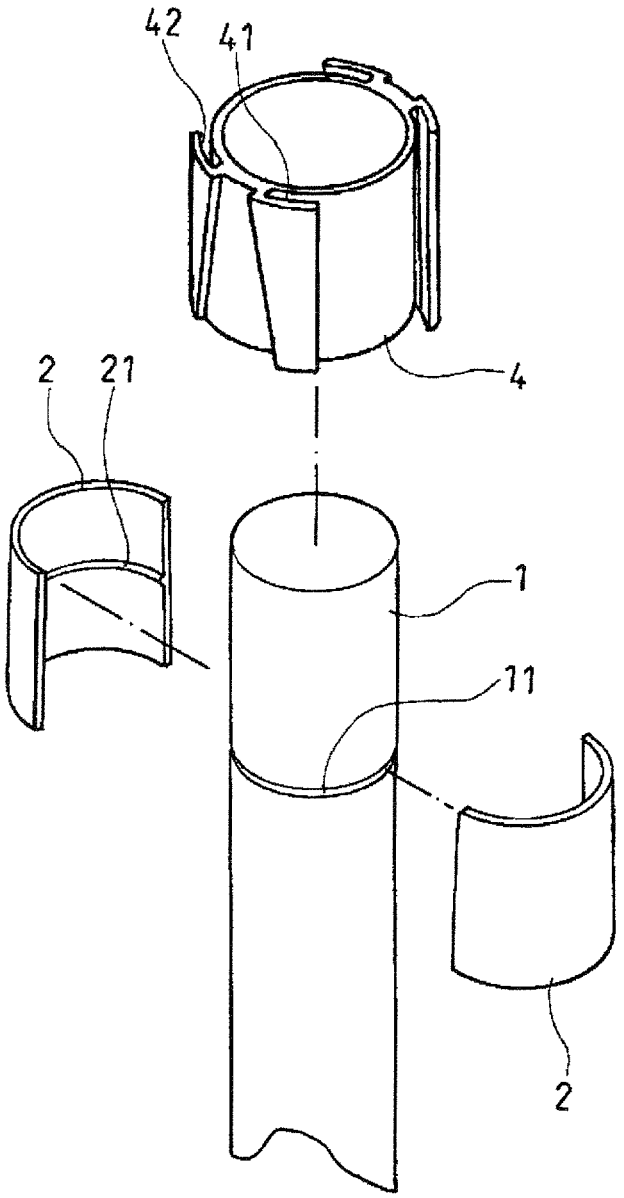
FIGS. 3 and 4 are schematic diagrams illustrating an assembly state of the preferred embodiment of the present invention.
Figure 4:
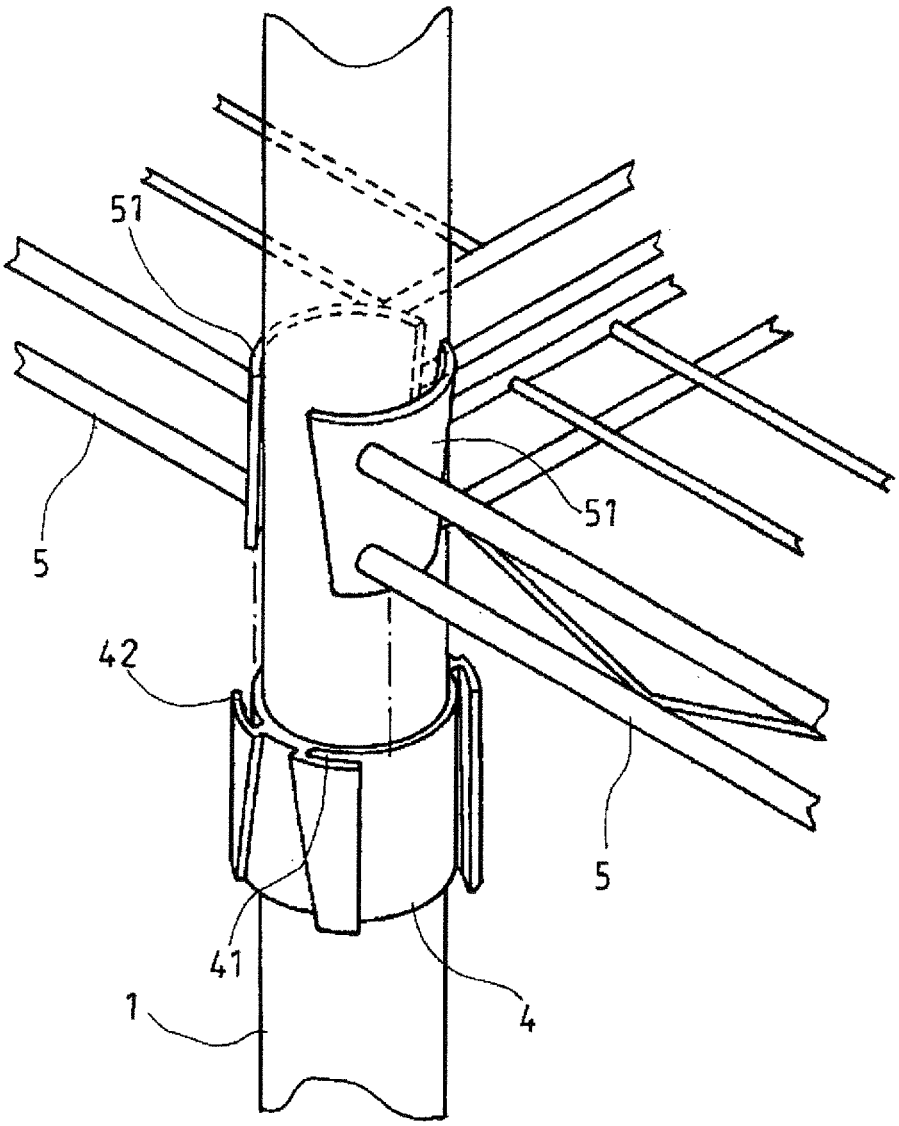

Please refer FIGS. 3 and 4 at the same time as illustrating an assembly state of the preferred embodiment of the present invention. The assembly of the present invention is similar to the assembled rack of the prior art that the rib 21 of the clip 2 is used to engage the groove 11 of the support tube 1 and then the secure sleeve 4 is inserted from above in order to tighten the clip 2 for securing the secure sleeve 4 in position. The buckling piece 51 of the bracket 5 is used to engage as inserted into the first slot 41 of the secure sleeve 4. Since the first slot 41 and the second slot 42 are in the downward and skewed taper shape and the buckling piece 51 of the bracket 5 is also in a downward and skewed taper shape, once the buckling piece 51 is inserted into the first slot 41, both of them will be tightened due to the geometry configuration (namely, they can only be disengaged by pulling the buckling piece 51 upward as it cannot keep moving downward) so as to secure the bracket 5 to the support tube 1 for constituting the unity storage shelf Further the second slot 42 can be used to engage the buckling piece 51 of the other bracket 5 in order to extend the multiply quantity of the bracket 5 in a parallel arrangement. Therefore convenience is achieved for both assembly and extension of the storage shelf while the extension is in an orderly manner.

Figure 5:
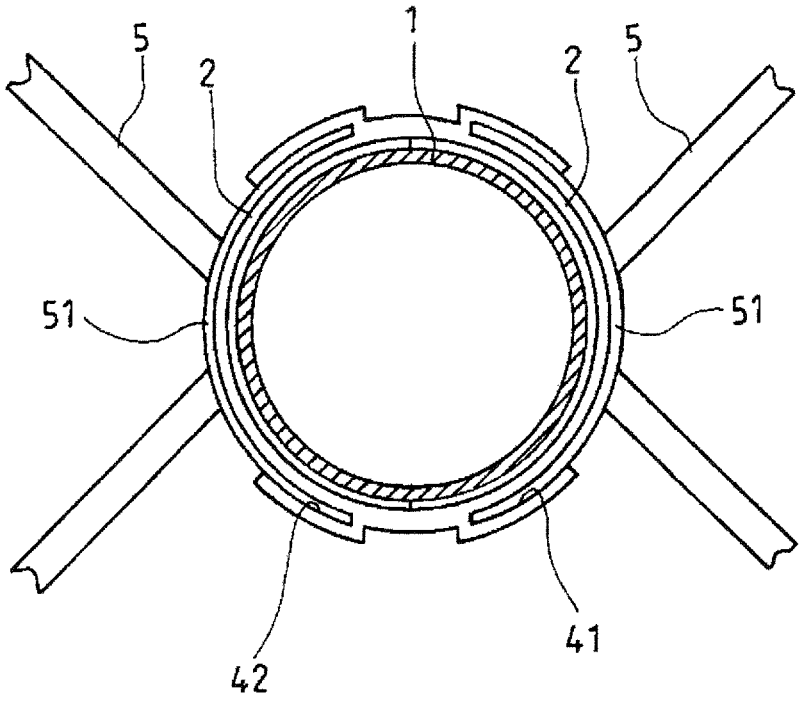
FIG. 5 is a schematic diagram illustrating an engagement of a secure sleeve and a buckling piece of the preferred embodiment of the present invention.

Please refer FIG. 5, an engagement of the secure sleeve 4 and the buckling piece 51 of the preferred embodiment of the present invention, together with FIG. 3. As shown, after assembly the secure sleeve 4 is secured at the support tube 1 that assembly of the bracket 5 only needs to insert the buckling piece 51 from above in order to engage by inserting into the first slot 41 and the second slot 42 of the secure sleeve 4 so as to extend two units of the storage shelf in parallel arrangement. The downward and skewed taper shape configuration of both the buckling piece 51, the first slot 41 and the second slot 42 are utilized to tighten the engagement of the buckling piece 51 as inserted the first slot 41 or the second slot 42 in order to position the bracket 5 to the support tube 1 in a secure manner that the bracket 5 will hardly come loose.

Figure 6:
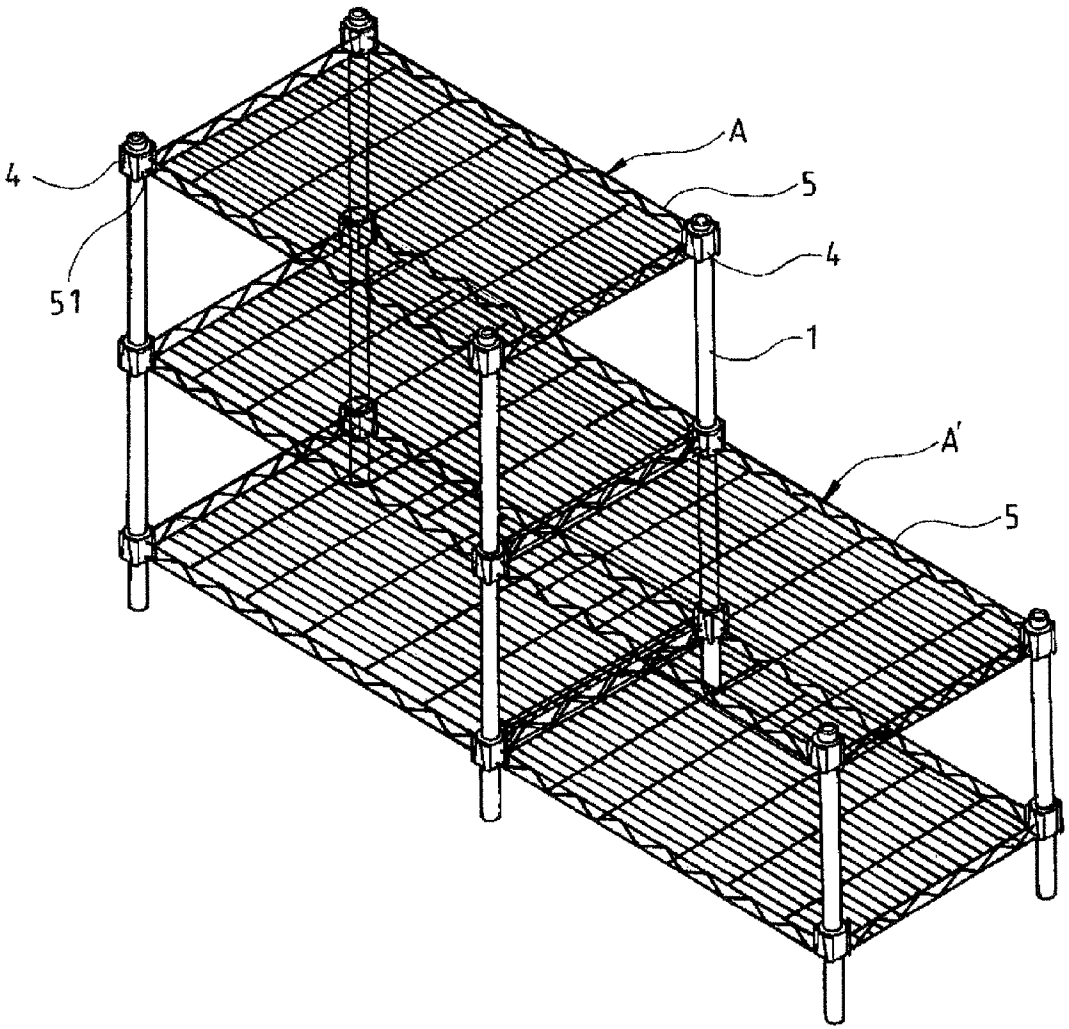
FIG. 6 is a three-dimensional diagram illustrating a completely assembled storage shelf of the preferred embodiment of the present invention.

Please refer FIG. 6, a three-dimensional diagram illustrating a completely assembled storage shelf of the preferred embodiment of the present invention, together with FIG. 3. As shown, the completely assembled unity storage shelf A of the present invention can be connected with the other completed assembled storage shelf A' by engaging the buckling piece 51 thereof as inserted into the second slot 42 of the secure sleeve 4 of the storage shelf A that both the storage shelf A and A' are connected in a parallel arrangement. Since both the storage shelf A and the storage shelf A' are connected by the same secure sleeve 4, there is no clearance in between both the storage shelf A and the storage shelf A' in a parallel arrangement. Therefore both the storage shelf A and storage shelf A' are not only in an orderly manner but also able to withstand an impact by accident and stay in the same orderly arrangement.

I claim:

1. A storage shelf comprising a secure sleeve mountable onto a support tube and a bracket connectable with said secure sleeve by a corner of said bracket so as to constitute an unity storage shelf by a connection between said bracket and said secure sleeve, wherein a multiple quantity of said bracket are selectively arranged and connected together in parallel for extension through a parallel connection;

wherein said secure sleeve is in a hollow cylindrical shape having an outer circumferential surface on which are mounted two L-shaped sheet elements to form an opening facing each other so as to define a first slot between the L-shaped sheet element, said bracket comprising a buckling piece mounted to the corner thereof and receivable and held in position in said first slot by having opposite side edges of said buckling piece respectively received in the openings of said L-shaped sheet elements and engaging said L-shaped sheet elements to constitute the unity storage shelf; the two L-shaped sheet elements of the first slot each have a closed end opposite to the opening thereof, the two L-shaped sheet elements being arranged to have the closed ends inclined with respect to each other so as to define a downward and skewed taper configuration, the buckling piece of said bracket being of a downward and skewed taper configuration corresponding to and receivable in the downward and skewed taper configuration of said first slot so as to establish a tight engagement between the first slot and the buckling piece received in the first slot.

2. The storage shelf of claim 1 wherein said secure sleeve comprises two additional L-shaped sheet elements mounted to the outer circumferential surface thereof to each form an opening facing each other so as define a second slot for receiving and holding therein a buckling piece of an additional bracket in order to extend the multiply quantity of said bracket by a parallel connection.

3. The storage shelf of claim 1, wherein the outer circumferential surface of said secure sleeve is curved and the buckling piece of said bracket is curved and corresponding in curvature to the outer circumferential surface of said secure sleeve.

4. The storage shelf of claim 2, wherein the two L-shaped sheet elements of the second slot each have a closed end opposite to the opening thereof, the two L-shaped sheet elements being arranged to have the closed ends inclined with respect to each other so as to define a downward and skewed taper configuration, the buckling piece of said additional bracket being of a downward and skewed taper configuration corresponding to and receivable in the downward and skewed taper configuration of said second slot so as to establish a tight engagement between the second slot and the buckling piece received in the second slot.

5. The storage shelf of claim 2, wherein the outer circumferential surface of said secure sleeve is curved and the buckling piece of said additional bracket is curved and corresponding in curvature to the outer circumferential surface of said secure sleeve.

6. The storage shelf of claim 2, wherein said first and second slots are provided on the secure sleeve in a symmetric arrangement.

* * * * *